US007083524B2

(12) United States Patent
Daniels

(10) Patent No.: US 7,083,524 B2
(45) Date of Patent: Aug. 1, 2006

(54) GOLF CLUB ALIGNING KIT AND METHOD OF USE

(76) Inventor: Tyrone S. Daniels, 1360 S. Main St., Springboro, OH (US) 45066

( * ) Notice: Subject to any disclaimer, the term of this patent is extended or adjusted under 35 U.S.C. 154(b) by 186 days.

(21) Appl. No.: 10/821,602

(22) Filed: Apr. 9, 2004

(65) Prior Publication Data

US 2004/0192458 A1 Sep. 30, 2004

Related U.S. Application Data

(63) Continuation-in-part of application No. 10/191,011, filed on Jul. 8, 2002, now Pat. No. 6,754,970.

(60) Provisional application No. 60/305,678, filed on Jul. 16, 2001.

(51) Int. Cl.
*A63B 69/36* (2006.01)

(52) U.S. Cl. ..... 473/201; 473/231; 473/251; 473/238

(58) Field of Classification Search ..... 473/201–204, 473/251–252, 244, 300–303, 287–292, 226, 473/231, 238; D21/756–758
See application file for complete search history.

(56) References Cited

U.S. PATENT DOCUMENTS

| | | | | | |
|---|---|---|---|---|---|
| 1,942,122 | A | * | 1/1934 | Reach | 40/628 |
| 2,437,404 | A | * | 3/1948 | Robinson | 473/203 |
| 2,546,426 | A | | 3/1951 | Bryant | |
| 2,973,581 | A | | 3/1961 | Rhodhamel | |
| 3,333,854 | A | * | 8/1967 | White | 473/288 |
| 3,684,294 | A | * | 8/1972 | Champion | 473/238 |
| 3,822,477 | A | | 7/1974 | Collins | |
| 4,104,802 | A | | 8/1978 | Johnston | |
| 4,128,244 | A | | 12/1978 | Duclos | |
| 4,245,392 | A | | 1/1981 | Heller | |
| 4,345,763 | A | | 8/1982 | Swanson | |
| 4,817,294 | A | | 4/1989 | Lai | |
| 4,885,847 | A | | 12/1989 | Korfanta | |
| 4,900,028 | A | | 2/1990 | Antonious | |
| 4,907,806 | A | | 3/1990 | Antonious | |
| 5,058,891 | A | * | 10/1991 | Takeuchi | 473/201 |
| 5,105,550 | A | | 4/1992 | Shenoha | |
| 5,421,098 | A | | 6/1995 | Muldoon | |
| 5,480,151 | A | * | 1/1996 | Adams | 473/238 |
| 5,716,288 | A | | 2/1998 | Sacco | |
| 5,820,477 | A | | 10/1998 | Redkey et al. | |
| 5,848,944 | A | | 12/1998 | Brannen | |
| 5,884,409 | A | | 3/1999 | Muldoon | |
| 6,149,537 | A | | 11/2000 | Hooker | |
| 6,200,227 | B1 | | 3/2001 | Sery | |
| 6,261,190 | B1 | | 7/2001 | Ashcraft | |
| 6,364,784 | B1 | | 4/2002 | Fuhre | |
| 6,394,910 | B1 | | 5/2002 | McCarthy | |

(Continued)

*Primary Examiner*—Sebastiano Passaniti
(74) *Attorney, Agent, or Firm*—Charles R. Wilson

(57) ABSTRACT

A preferred golf club includes a first alignment mark on a grip of the club and a second alignment mark on the head proximate a centerline of the head. A preferred method for addressing a ball involves positioning the second alignment mark proximate the center of the ball; pivoting the club until the first alignment mark overhangs the ball; aiming the first alignment mark toward a target; positioning one's feet parallel to the first alignment mark; and again centering the second alignment mark with the ball. One object of the present invention is to assist a golfer both in striking a golf ball with the sweet spot of a club head and to enable the golfer to accurately sight on the target.

14 Claims, 6 Drawing Sheets

U.S. PATENT DOCUMENTS 6,409,610 B1 * 6/2002 Ahn et al. ..... 473/249
6,449,860 B1 9/2002 Nakai
6,524,193 B1 * 2/2003 Devore ..... 473/251
6,723,001 B1 * 4/2004 Ferris ..... 473/251
6,739,980 B1 * 5/2004 Scott et al. ..... 473/200

* cited by examiner 22
30
56
44
20
58
110
12
104
10
100
102
42
40
14
16
46
48
2
3
4
5
6
50

GOLF CLUB ALIGNING KIT AND METHOD OF USE

CROSS-REFERENCE TO RELATED APPLICATIONS

The present application is a continuation-in-part of U.S. patent application Ser. No. 10/191,011, filed Jul. 8, 2002, Now U.S. Pat. No. 6,754,970 which claimed the priority of U.S. Provisional Application No. 60/305,678, filed Jul. 16, 2001.

BACKGROUND OF THE INVENTION

1. Field of the Invention

The invention relates to a golf club aligning kit and, more particularly, to a mechanical alignment system used to center a golf ball that is in the field of play with the center of the club face and to center a golfer's stance with the line from the ball to the target.

2. Description of the Prior Art

Golf requires a player to perform an extremely difficult act, over and over again without deviation. This act is to hit a ball with a club so that the ball goes where the player wishes the ball to go.

A conventional golf club includes a shaft having a first end portion and a second end portion. The first end portion mounts an elongated grip which a player uses to grasp the club with one or both hands. The second end portion supports a club head which defines a club face.

Power and accuracy are two of the main goals of golf. In order to achieve these goals a golfer must make consistently good contact whenever the ball is struck. This means that the golfer must contact the ball with the club face right on the "sweet spot;" hit the ball with a club face that is perfectly "square," that is perpendicular to the desired path of the ball (line to the target); and swing the club in such a way that impact occurs when the club head is traveling directly down the desired ball flight path.

The "sweet spot" on the face of a golf club is a small area on the club face surrounding the center of percussion of the head which most efficiently transfers energy from the club to the ball. (The center of percussion roughly coincides with the geometric center of the club head.) Striking a ball on the sweet spot of the club face provides the hardest and straightest shot for a given swing. The standard golf ball is exactly 1.68 inches (approximately 4.26 cm) in diameter. The average club face has anywhere from four to five square inches (approximately 26–33 $cm^2$) of area. Only about one square inch (approximately 6 $cm^2$) of that is the sweet spot.

A player must swing the club over the player's shoulders and then down and around in a precise arc so that the tiny sweet spot on that club face will squarely smack the small golf ball sitting on the tee or in the grass. The club face is on the end of a shaft whose length varies from 32 inches (approximately 0.8 m) all the way up to 45 inches (approximately 1.1 m) or more. One of the challenges of golf is to correctly align the club face with the ball so that the sweet spot hits the ball after swinging through an arc of this size.

The lie angle of a club is the angle the shaft makes with the ground when the bottom of the club head is resting flat on the ground. An improper lie angle will cause the ball to go left or right of the target. The correct lie angle will cause the ball to fly straight to the target.

All golfers must develop a proper stance that is parallel to the club shaft, the club head and the ball. The stance must be in a straight line toward the target. Most amateur golfers make the error of not properly aligning the ball to the target, thereby not obtaining the correct line to the target.

Most professional golfers aim in a consistent manner. First, they stand behind the ball and sight the target line. Then they choose a secondary aiming point about two or three feet in front of the ball, one that sits directly on the line to the target. Third, they aim the bottom edge of the club head so it is perpendicular to the line leading from the ball to the secondary aiming point.

Ashcraft U.S. Pat. No. 6,261,190 proposes a putter having a club head with an alignment figure for aligning the sweet spot of the putter with a golf ball. More specifically, Ashcraft proposes a golf putter head bearing an alignment figure defining a periphery and having two or more portions, each including sections of the periphery. Each portion is disposed on a respective surface of the golf putter head in such a manner as to indicate the degree of orientation of the putter by the degree of alignment between the portions of the alignment figure. An elongated sweet spot indicating line may be provided on either, or both, of the surfaces to indicate the sweet spot on the face of the putter head.

Duclos U.S. Pat. No. 4,128,244 proposes a golf club head having a deeply slotted portion or means simulating the same, placed toward the rear of the golf club head in alignment with the plane along which both of the golfer's eyes should lie and the line along which it is desired to hit the ball. In the usual case, the slot is also aligned with the center of percussion of the golf club head.

Antonious U.S. Pat. Nos. 4,907,806 and 4,900,028 propose golf irons having alignment and sighting areas formed on the top ridges of the club heads. More specifically, Antonious' club head includes a top ridge having a first portion adjacent the heel which diverges and extends upwardly and outwardly from the heel to a point where it changes direction and forms a second straight sighting section which extends substantially horizontally and perpendicularly to the intended flight line. The sighting section extends to a point positioned directly over the center of percussion of the club head. Sight lines are formed on the sighting section and extend downwardly across the ball striking face through the center of percussion. The golfer can properly align the club head with a ball by utilizing the sighting section at the uppermost portion on the club face.

Each of these proposals appears to be limited to use on clubs with specially-designed heads. They would not be readily available as a retrofit to conventional golf clubs. Another drawback to each of the foregoing proposals is that they are of limited assistance in squaring the club head with the ball and in aiming a shot at a target, such as a hole. There remains a need in the art for a golf club aligning kit which directly assists the golfer both in aligning the club head with the ball and in aiming shots. There remains an additional need for such a kit which can be used in connection with conventional golf clubs.

SUMMARY OF THE INVENTION

These needs and others are addressed by means of a kit for preparing a golf club so as to promote the power and accuracy of shots made using the club. A preferred kit includes a tool, at least two ligatures and a marker. The preferred tool includes a base and an arm. The base defines a center line and bears index marks for indicating distance from the center line. (As used herein, "mark" includes any visible indicia, whether integral to the golf club or applied by any means to the club.) The arm is secured pivotally to the base along the center line.

A preferred method for using the kit includes the steps of positioning the club near the base; centering the club head relative to the center line of the base; binding the club head to the base with one or more of the ligatures; pivoting the arm to an orientation proximate the shaft; binding the shaft to the arm using an additional one or more of the ligatures; marking the grip with an alignment mark substantially perpendicular to a direction of extension of the arm; and marking the club head with a second alignment mark proximate the center line. A preferred method by which a golfer may use a golf club so marked to address a golf ball comprises the steps of positioning the second alignment mark proximate a center of the golf ball facing the target; pivoting the golf club until the first alignment mark is aligned over the center of the golf ball while keeping the second alignment mark proximate the center of the golf ball; aiming the first alignment mark toward the target; moving to a standing position such that the golfer's feet are parallel to the first alignment mark; and centering the second alignment mark with the center of the golf ball. Once the golfer has addressed the ball, the golfer may swing with confidence that, given a proper swing, the power and accuracy of the golfer's shot will likely improve.

Thus, a preferred golf club in accordance with the invention includes a first alignment mark and a second alignment mark. An especially preferred first alignment mark comprises a line segment or other indicium on a top surface of a grip of the golf club extending in a direction transverse (most preferably, substantially normal) to the club face. An especially preferred second alignment mark comprises a line segment or other indicium extending through the center of the club face and onto a top surface of the club head in a direction transverse (most preferably, substantially perpendicular) to the length of the club head. Other suitable forms of alignment marking will be apparent to those of ordinary skill in the art from the objects and features set forth below.

When the preferred method for addressing a golf ball is used, the first alignment mark is on the same target line as the line of the club face. The first alignment mark allows the golfer to check that his stance is parallel to the line of the club face by laying the shaft against the golfer's belt and comparing the golfer's stance to the direction of the first alignment mark. Likewise, the combination of the first and second alignment marks allows the golfer to check that the lie angle is proper.

The configuration of the first and second alignment marks is not critical to the present invention. Suitable alignment marks include paint, ink, colored polymer, adhesive tape or other medium applied to the golf club; embossed ridges or other raised features on the surface of the club; recessed channels or other features sunk into surfaces of the golf club; and rigid (e.g., colored plastic) inserts embedded in the golf club; and combinations of the foregoing. Other suitable means for marking golf clubs will be apparent to those of ordinary skill in the art. The first and second alignment marks preferably are elongated so as to indicate direction, though elongation of the alignment marks, particularly of the second alignment mark, is not critical to the invention. Especially preferred alignment mark configurations include line segments, triangles, ellipses, or arrays of separate figures. The invention is adaptable to any class or make of golf club, including putters, wedges, irons and drivers.

Therefore, it is one object of the present invention to assist a golfer both in striking a golf ball with the sweet spot of a club head and to enable the golfer to accurately sight on the target. It is another object of the invention to provide a golf club alignment kit and a method of use which allows a golfer to properly align the sweet spot of the club head with the ball; to properly square the club face with the ball; and to properly align the golfer's stance with the line from the ball to the target. The invention will be further described in conjunction with the appended drawings and following detailed description.

DETAILED DESCRIPTION OF THE PREFERRED EMBODIMENT

Figure 1:
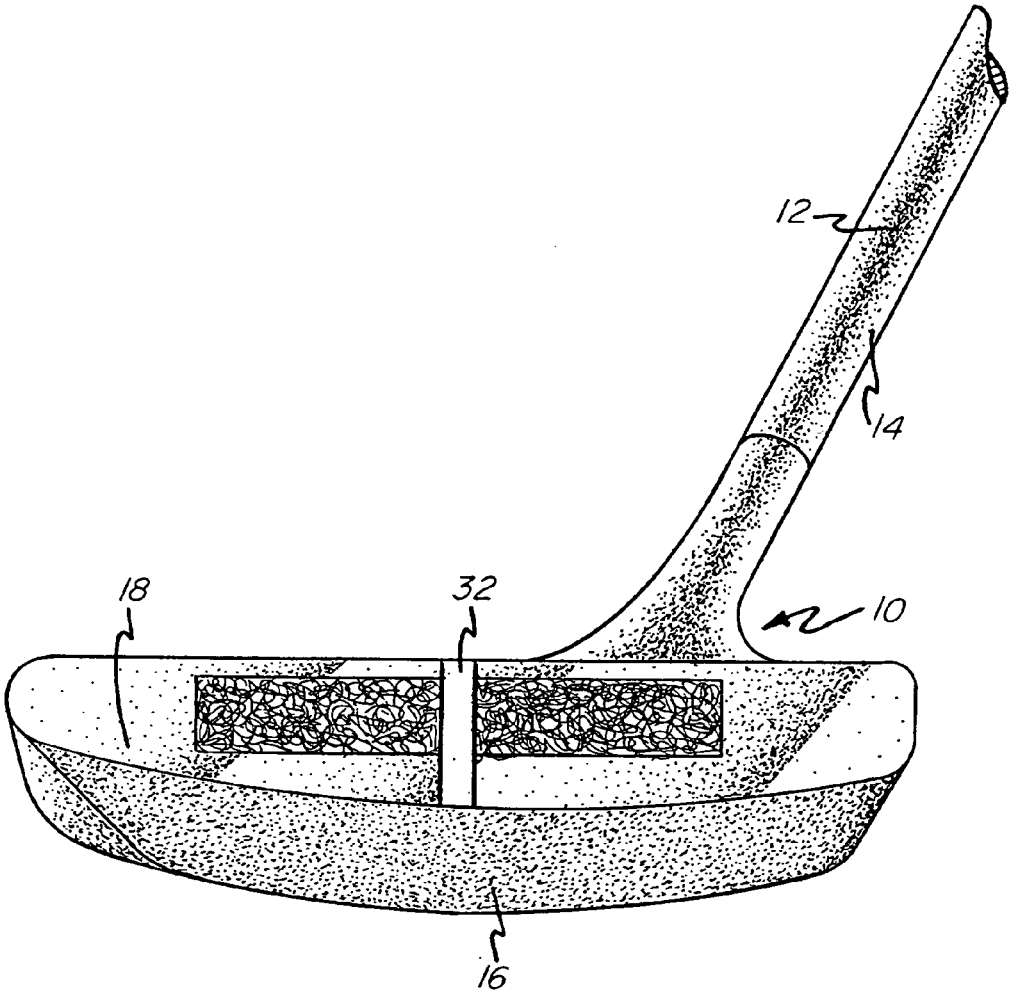
FIG. 1 is a front elevational view of a conventional club head marked in accordance with the invention.
Figure 2:
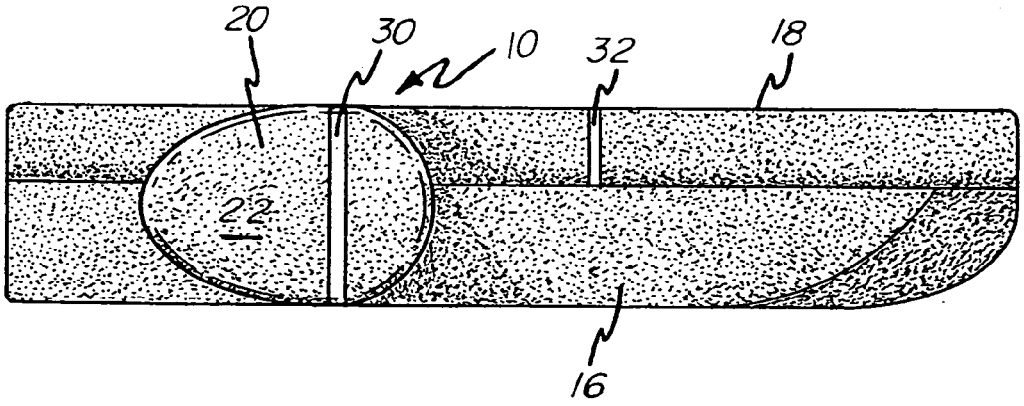
FIG. 2 is a top plan view of a conventional golf club marked in accordance with the invention.

Referring initially to FIG. 1 of the drawings, a conventional golf club 10 includes a shaft 12 defining a first portion (not shown) and a second portion 14. The second portion of the shaft 12 supports a head 16. The head 16 defines a face 18. Referring to FIG. 2, the golf club 10 further includes a grip 20 mounted on the first portion (not shown) of the shaft 12. The grip 20 defines a grip top surface 22 transverse to the length of the shaft 12.

With continuing reference to FIG. 2, the preferred grip 20 is marked with a first alignment mark 30 and the preferred head 16 is marked with a second alignment mark 32. The preferred first alignment mark 30 is in the form of a line segment extending in a direction transverse (most preferably, substantially normal) to the club face 18. As best shown in FIG. 1, the preferred second alignment mark 32 is a line segment extending through the center of the head 16 and optionally, as suggested in FIG. 2, continuing over the top surface of the club head 16 in a direction parallel to the first alignment mark 30 and transverse (most preferably, substantially normal) to the club face 18. The particular forms of marks appearing in the drawings are not critical to the invention and other suitable forms of alignment marking will be apparent to those of ordinary skill in the art.

Figure 3:
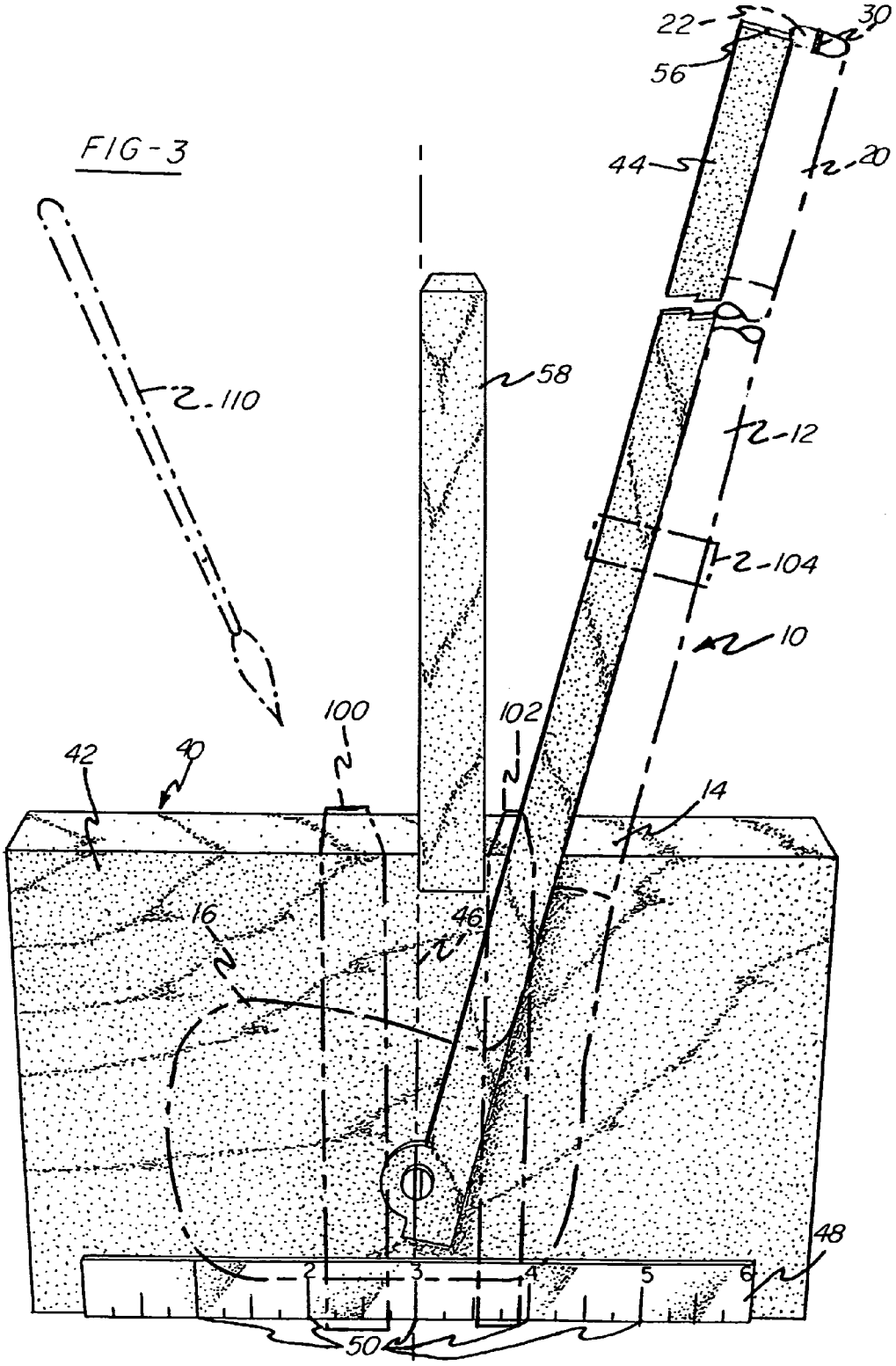
FIG. 3 is a front elevational view of a first preferred tool for use in a golf club aligning kit in accordance with the invention, with a golf club to be prepared by the kit shown in phantom.

As shown in FIG. 3, a preferred golf club alignment kit includes a tool 40 having a base 42 and an arm 44 pivotally and eccentrically supported by the base 42 along a center line 46 of the base 42. The preferred base 42 includes a ruler 48 or the like bearing index marks 50 at equal, periodic intervals of distance. Most preferably, the ruler 48 is positioned so that one of the index marks 50 lies along the center line 46.

An especially preferred tool 40 includes sighting aids for assisting a user in marking the first and second alignment marks 30 (FIG. 2), 32 (FIGS. 1 and 2). In accordance with an especially preferred embodiment, an indicator line 56 is provided on the arm 44 extending in a direction perpendicular to the surface of the base 42 on which the ruler 48 is positioned. The especially preferred embodiment further includes a sight 58 having one straight side aligned with the center line 46.

Figure 4:
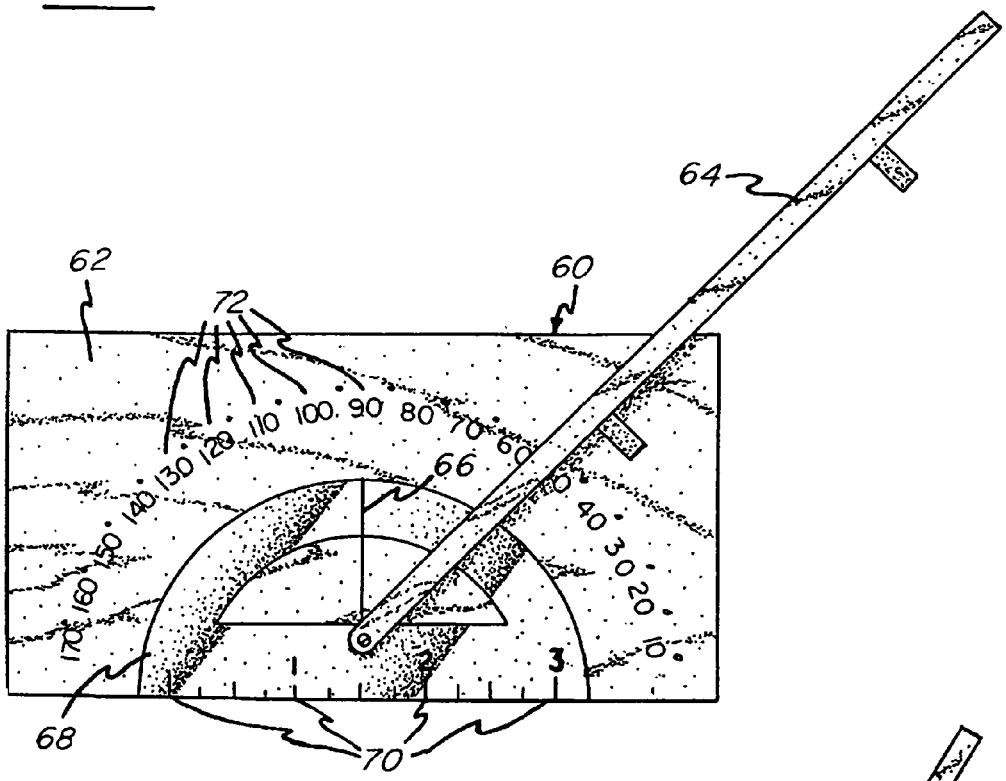
FIG. 4 is a front elevational view of a second preferred tool for use in a golf club aligning kit in accordance with the invention.

As shown in FIG. 4, an alternative tool 60 includes a base 62 and an arm 64 pivotally supported by the base 62 along a center line 66 of the base 62. The preferred base 62 includes a protractor 68 or the like bearing linear index marks 70 at equal, periodic intervals of distance and angular index marks 72 at equal, periodic intervals of circumference. Most preferably, the protractor 68 is centered on the center line 66. Then, the angular index marks 72 provide a measure of the angular departure of the length of the arm 64 from the center line 66.

Figure 5:
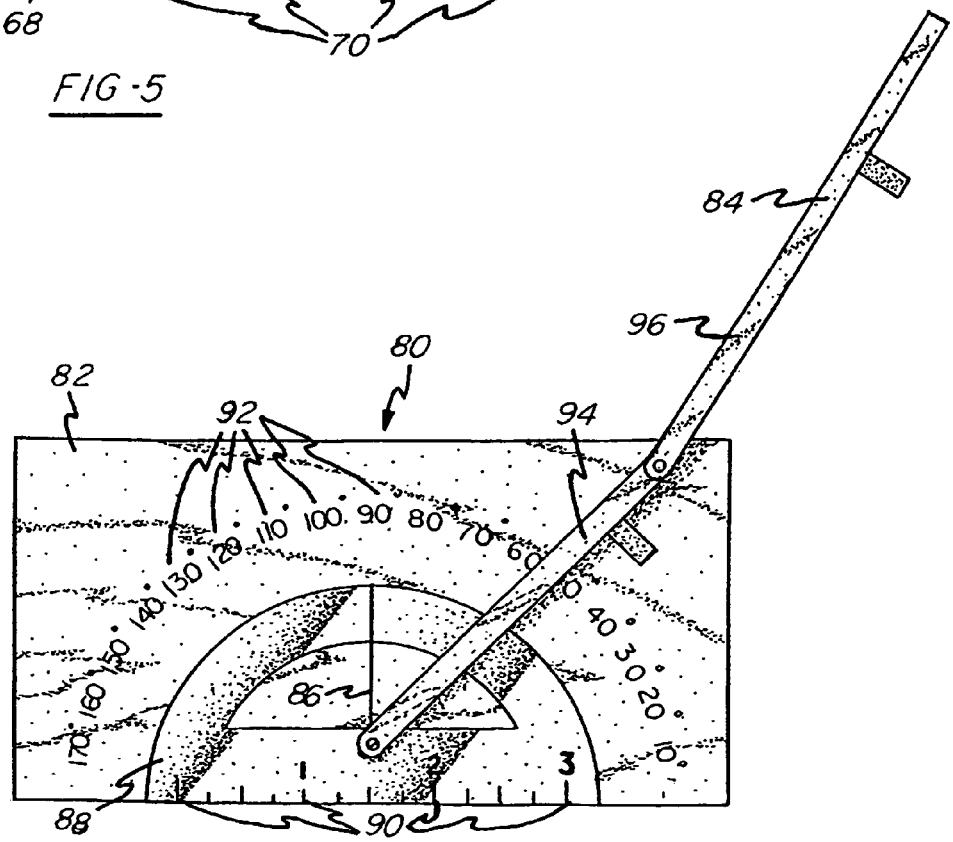
FIG. 5 is a front elevational view of a third preferred tool for use in a golf club aligning kit in accordance with the invention.

As shown in FIG. 5, another alternative tool 80 includes a base 82 and an arm 84 pivotally supported by the base 82 along a center line 86 of the base 82. The preferred base 82 includes a protractor 88 or the like bearing linear index marks 90 at equal, periodic intervals of distance and angular index marks 92 at equal, periodic intervals of circumference. Most preferably, the protractor 68 is centered on the center line 86. The arm 84 comprises a first arm segment 94 pivotally supported by the base 82 along the center line 86 and second arm segment 96 pivotally supported by a free end of the first arm segment 94. Then, the angular index marks 92 provide a measure of the angular departure of the length of the first arm segment 94 from the center line 66.

The preferred bases 42 (FIG. 3), 62 (FIG. 4), 82 (FIG. 5) and arms 44 (FIG. 3), 64 (FIG. 4), 84 (FIG. 5) are made of wood. Nevertheless, those skilled in the art will recognize that any rigid material, including plastic and metal, will suffice for the manufacture of the base 42 (FIG. 3), 62 (FIG. 4), 82 (FIG. 5) and arm 44 (FIG. 3), 64 (FIG. 4), 84 (FIG. 5). Additionally, although the base 42 (FIG. 3), 62 (FIG. 4), 82 (FIG. 5) has been shown as a rigid block mounting a ruler 48 (FIG. 3) or a protractor 68 (FIG. 3), 88 (FIG. 4), those skilled in the art will recognize that a less expensive, but also less strong, tool 40 (FIG. 3), 60 (FIG. 4), 80 (FIG. 5) can be constructed by pivotally affixing the arm 44 (FIG. 3), 64 (FIG. 4), 84 (FIG. 5) directly to a ruler or protractor which then serves as a base for the tool (not shown).

Returning to FIG. 3, a golf club alignment kit additionally includes ligatures 100, 102 and 104; and a marker 110. The preferred ligatures 100, 102, 104 include flexible plastic or fabric straps (not shown) mounting complementary hook and loop fastening material (not shown) at or near its ends (not shown) for securing the ends together, although other types of ligatures (not shown) suitable for use will be apparent to those of ordinary skill in the art. Preferred markers include paint brushes and paint (not shown), ink markers (not shown), adhesive tape (not shown) and styluses (not shown), although other suitable markers (not shown) will be apparent to those of ordinary skill in the art.

A preferred method for preparing the golf club 10 includes the step of centering the head 16 of the club 10 against the base 42. Most preferably, the head 16 is centered by positioning the front and back ends of the head 16 equidistant from the center line 46, using the index marks 50 as indicators of distance. Once the head 16 is centered against the base 42, the head 16 is bound to the base 42 using the ligatures 100, 102; and the shaft 12 is bound to the arm 44 using the ligature 104. Most preferably, the ligature 100 is positioned in front of the center line 46 while the ligatures 102 is positioned behind the center line 46 to provide a tight bond holding the head 16 against the base 42. Where the ruler 48 is replaced with a protractor 68 (FIG. 4), 88 (FIG. 5), the angular index marks 72 (FIG. 4), 92 (FIG. 5) provide a means of comparison between the angle of the shaft 12 and the manufacturer's specifications. Although three ligatures 100, 102, 104 are shown, it is within the contemplation of the invention to use more or fewer ligatures subject to the desire to immobilize the club 10 against the tool 40.

Once the user has checked that the club 10 is bound tightly to the tool 40, the first and second alignment marks 30 (FIG. 1), 32 (FIGS. 1 and 2) are marked onto the club 10. Most preferably, the shaft 12 is bound to the arm 44 such that the top of the grip 20 is aligned with the top of the arm 44. Then, the marker 110 is used to draw the first alignment mark 30 onto the top of the grip 20 in alignment with, or parallel to, the indicator mark 56 on the top of the arm 44, as suggested in FIGS. 3 and 7. The marker 110 is used then to draw the second alignment mark 32 (FIGS. 1 and 2) onto the club face 18 (FIG. 1), using the index marks 50 and the optional sight 58 as guides. Once the first and second alignment marks 30, 32 are drawn onto the club 10, the ligatures 100, 102, 104 are released and the club 10 is removed from the tool 40.

Although the preferred method specified in the foregoing description is best adapted to produce first and second alignment marks 30 (FIGS. 2 and 7), 32 (FIGS. 1 and 2) in the form of line segments, those skilled in the art will recognize that the alignment marks 30, 32 may take any form suitable to advise a golfer (not shown) concerning the direction of the club face 18 (FIGS. 1 and 2) and the location of the sweet spot of the club head 16 (FIGS. 1–3), respectively. It is particularly desirable that the first alignment mark 30 (FIGS. 2 and 7) be elongated either in the direction of the club face 18 (FIGS. 1 and 2) or in another direction (e.g., parallel to the club face 18) from which the golfer (not shown) can determine the direction of the club face 18. It follows that the particular shape, color, material composition, elevation and configuration of the alignment marks 30 (FIGS. 2 and 7), 32 (FIGS. 1 and 2) is not critical to the invention.

Figure 7:
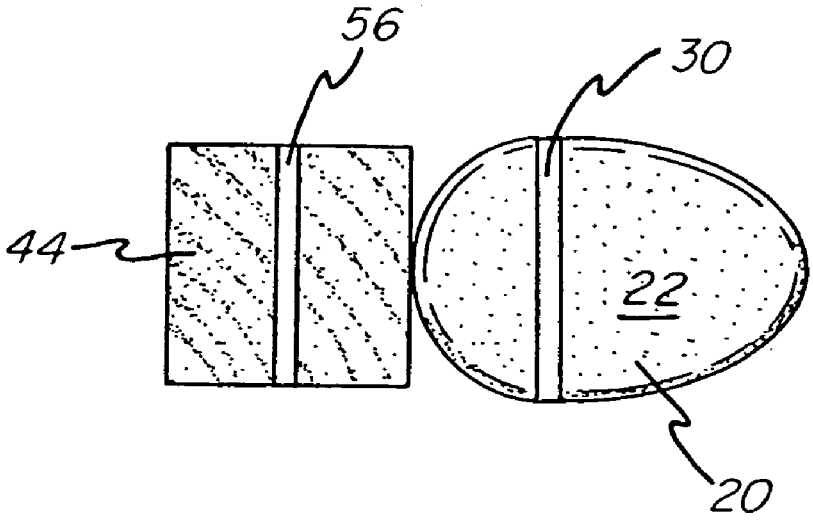
FIG. 7 is a schematic view of the arm of the preferred tool and of the golf club grip.

Likewise, while the foregoing description specifies a preferred method for marking a golf club in accordance with the invention, other suitable techniques for producing alignment marks 30 (FIGS. 2 and 7), 32 (FIGS. 1 and 2) on existing and newly manufactured club will be apparent to those or ordinary skill in the art. For example, it is within the contemplation of the invention to form the first and second alignment marks 30 (FIGS. 2 and 7), 32 (FIGS. 1 and 2) by cutting indicia into the top surface 22 (FIGS. 2 and 7) of the club grip 20 (FIGS. 2 and 7) and into the club head 16 (FIGS. 1–3), respectively. Alternatively, it is also within the contemplation of the invention to form alignment marks 30 (FIGS. 2 and 7), 32 (FIGS. 1 and 2) embossed onto, or sunk into, the top surface 22 (FIGS. 2 and 7) of the club grip 20 (FIGS. 2 and 7) and into the club head 16 (FIGS. 1–3). One suitable technique is to include such marks in a wall of a mold or form (not shown) used for casting the club grip 20 (FIGS. 2 and 7) and the club face 18 (FIGS. 1 and 2). It is also within the contemplation of the invention to mold colored polymer (e.g., plastic or rubber, not shown) onto the top surface 22 (FIGS. 2 and 7) of the club grip 20 (FIGS. 2 and 7) and onto the club head 16 (FIGS. 1 and 2) to form the alignment marks. Likewise, it is within the contemplation of the invention to place a rigid marking insert (not shown) into a mold or form (not shown) used for molding the grip 20 (FIGS. 2 and 7). Other suitable techniques for producing the first and second alignment mark 30 (FIGS. 2 and 7), 32 (FIGS. 1 and 2) are within the ordinary skill in the art and that particular technique used is not critical to the present invention. Where the grip 20 (FIGS. 2 and 7) is not integral with the shaft 12 (FIG. 2), it is within the contemplation of the invention to provide an asymmetrical profile for the first end portion (not shown) of the shaft 12 (FIGS. 1 and 2) or a detent (not shown) between the grip 20 and the shaft 12 to limit rotation of the grip 20 relative to the shaft 12 once the first alignment mark 30 (FIGS. 2 and 7) is applied to the grip 20.

Figure 6:
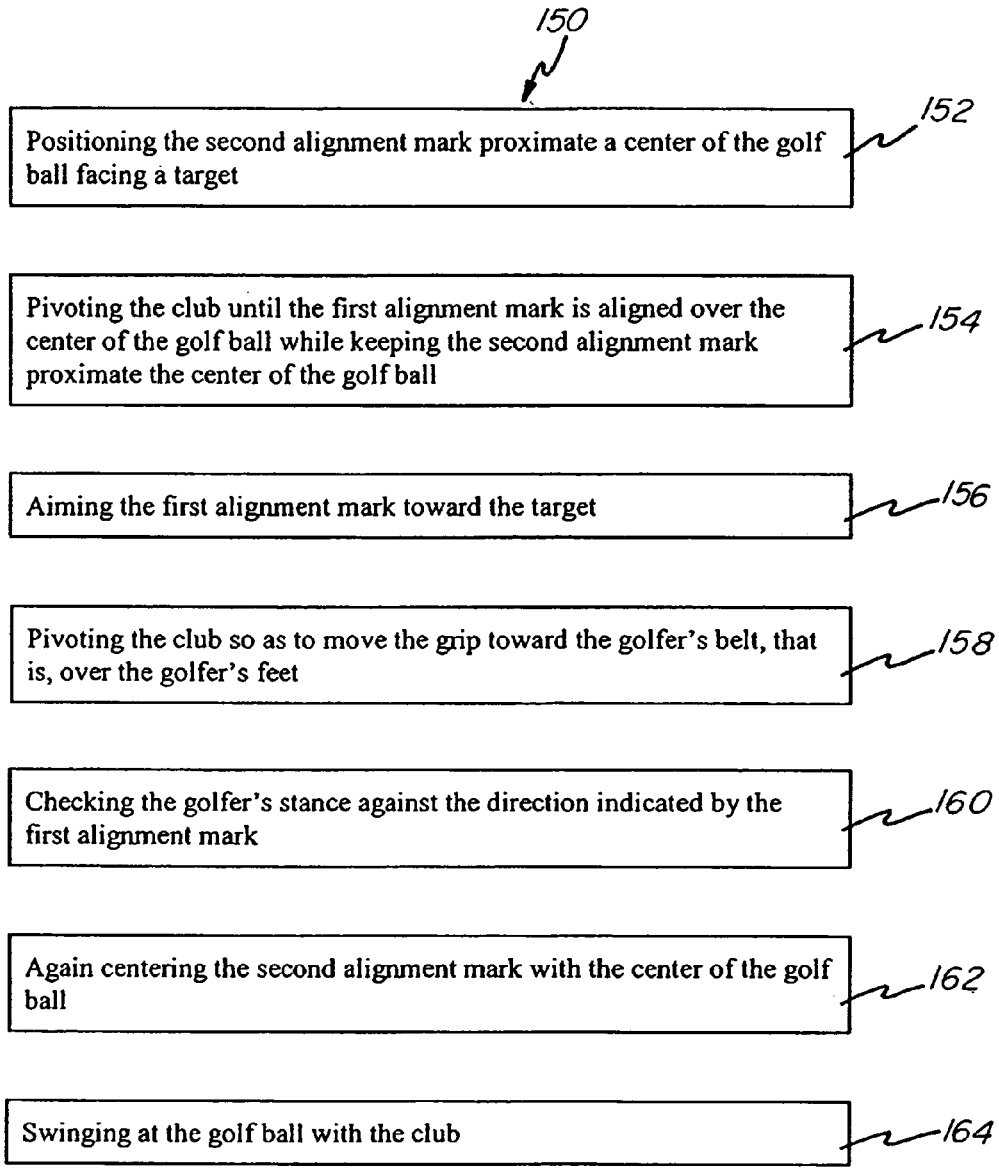
FIG. 6 is a flowchart illustrating a method for addressing a golf ball using a club prepared in accordance with the present invention.

A preferred method for addressing a conventional golf ball (not shown) using the golf club 10 (FIGS. 1–3) is illustrated in FIG. 6. The preferred method 150 comprises the step 152 of positioning the second alignment mark 32 (FIGS. 1 and 2) proximate a center of the golf ball (not shown) facing a target (not shown); the step 154 of pivoting the club 10 until the first alignment mark 30 (FIGS. 1 and 3) is aligned over the center of the golf ball while keeping the second alignment mark 32 (FIGS. 1 and 2) proximate the center of the golf ball; the step 156 of aiming the first alignment mark 30 (FIGS. 1 and 3) toward the target; the step 158 of moving the golfer (not shown) to a standing position such that the golfer's feet (not shown) are parallel to the first alignment mark 30 (FIGS. 1 and 23); the step 160 of pivoting the club 10 so as to move the grip 20 (FIGS. 2 and 3) toward the golfer's belt (not shown), that is, over the golfer's feet; the step 162 of checking the golfer's stance against the direction indicated by the first alignment mark 30 (FIGS. 1 and 3); the step 164 of again centering the second alignment mark 32 with the center of the golf ball; and the step 166 of swinging at the golf ball with the club 10.

It will be apparent from the foregoing description that the preferred kit 40 (FIG. 3), 60 (FIG. 4), 80 (FIG. 5) and methods in accordance with the invention allow a golfer to properly align the sweet spot of the club head 16 (FIGS. 1–3) with a golf ball (not shown); to properly square the club face 18 (FIG. 1) with the ball; and to properly align the golfer's (not shown) stance with the line (not shown) from the ball (not shown) is used, the first alignment mark 30 (FIGS. 1 and 3) is on the same target line as the line of the club face 18 (FIG. 1), so as to provide a reference for checking not only that the club face 18 (FIG. 1) is square but also to check the golfer's stance and the placement of the golfer's feet (not shown). Furthermore, the preferred golf club alignment kit in accordance with the invention permits the golfer (not shown) to prepare or retrofit a conventional golf club 10 to perform these tasks at relatively minor cost. The preferred methods specified in the foregoing description provide accurate and repeatable means for sighting golf balls to targets; and are applicable to any class or make of golf club.

Although this invention has been described in conjunction with certain specific forms and modifications thereof, it will be appreciated that a wide variety of other modifications can be made without departing from the spirit and scope of the invention.

What is claimed is:

1. A golf club designed to aid its user to more accurately aim a club head of the golf club towards a target and assist the user to squarely strike a golf ball with the club head for improved accuracy and power in playing golf, said golf club comprising:

(a) a shaft having a first end portion and a second end portion wherein the first end portion has mounted thereon an elongated grip with a top surface and further wherein the top surface of the grip has a first elongated alignment mark which extends across the top surface; and (b) a club head supported on the second end portion of the shaft, said club head having a club face with a second elongated alignment mark extending across a top surface proximate a centerline of the club head and substantially perpendicular to the club face, said secondary elongated alignment mark substantially parallel to the first elongated alignment mark on the top surface of the grip member, wherein the golf club user uses both the first elongated alignment mark on the top surface of the grip member and the second elongated alignment mark on the club head to accurately aim the club face of the club head towards the target such that the club head squarely hits the golf ball.

2. The golf club as recited in claim 1 wherein the golf club is a putter.

3. The golf club as recited in claim 1 wherein the golf club is an iron.

4. The golf club as recited in claim 1 wherein the golf club is a wedge.

5. The golf club as recited in claim 1 wherein the golf club is a driver.

6. The golf club as recited in claim 1 wherein one of said first and second elongated alignment marks includes a line segment.

7. The golf club as recited in claim 1 wherein one of said first and second elongated alignment marks includes a medium applied to the golf club.

8. The golf club as recited in claim 1 wherein one of said first and second elongated alignment marks is embossed onto the golf club.

9. The golf club as recited in claim 1 wherein one of said first and second elongated alignment marks is sunk into the golf club.

10. The golf club as recited in claim 1 wherein one of said first and second elongated alignment marks includes a raised ridge.

11. The golf club as recited in claim 1 wherein one of said first and second elongated alignment marks includes a recessed channel.

12. A golf club designed to aid its user to more accurately aim a club head of the golf club towards a target and assist the user to squarely strike a golf ball with the club head for improved accuracy and power in playing golf, said golf club comprising:

(a) a shaft having a first end portion and a second end portion wherein the first end portion has mounted thereon an elongated grip with a top surface and further wherein the top surface of the grip has a first elongated alignment mark which extends across the top surface; and (b) a club head supported on the second end portion of the shaft, said club head having a rearward end and a forward end with a centerline substantially equidistant between the rearward and forward ends, further having a substantially planar club face with a second elongated alignment mark extending across a top surface proximate the centerline of the club head and substantially perpendicular to the club face, said secondary elongated alignment mark substantially parallel to the first elongated alignment mark on the top surface of the grip member, wherein the golf club user uses both the first elongated alignment mark on the top surface of the grip member and the second elongated alignment mark on the club head to accurately aim the club face of the club head towards the target such that the club head squarely hits the golf ball.

13. The golf club as recited in claim 12 wherein the first elongated alignment mark and the second elongated alignment mark are each recessed channels.

14. The golf club as recited in claim 12 wherein the golf club is a putter.

* * * * *